United States Patent [19]

Theilacker

[11] Patent Number: 4,537,130

[45] Date of Patent: Aug. 27, 1985

[54] STRIPPER FOR A ROLLER CLEANING DEVICE

[75] Inventor: Klaus Theilacker, Friedberg, Fed. Rep. of Germany

[73] Assignee: M.A.N.-Roland Druckmaschinen Aktiengesellschaft, Offenbach am Main, Fed. Rep. of Germany

[21] Appl. No.: 588,664

[22] Filed: Mar. 12, 1984

[30] Foreign Application Priority Data

Mar. 17, 1983 [DE] Fed. Rep. of Germany ..... 3309557

[51] Int. Cl.[3] ..... B41F 35/04

[52] U.S. Cl. ..... 101/425; 15/256.51; 355/15

[58] Field of Search ..... 15/256.5, 256.51, 100, 15/102, 250.36, 250.10; 101/167, 425; 118/652; 100/174; 355/15

[56] References Cited

U.S. PATENT DOCUMENTS

| | | | |
|---|---|---|---|
| 3,048,872 | 8/1962 | Kerrigan | 15/250.36 |
| 3,548,441 | 12/1970 | Kruger | 15/250.10 |
| 3,871,049 | 3/1975 | Workman | 15/250.10 |
| 4,344,361 | 8/1982 | MacPree et al. | 355/15 |
| 4,367,691 | 1/1983 | Bergs | 15/256.5 |
| 4,458,376 | 7/1984 | Sitko | 15/256.5 |

*Primary Examiner*—Edward L. Roberts

*Attorney, Agent, or Firm*—Frishauf, Holtz, Goodman & Woodward

[57] ABSTRACT

A stripper for a printing machine cleaning device includes a shaped pressure hose, which is disposed parallel to the roller of the printing machine that is to be cleaned. The cross-sectional shape of the hose can be varied by being pressurized. The surface of the pressure hose remote from the roller is secured on a rigid rail, while the surface of the pressure hose remote from the rail can be pressed, as a result of pressurization of the hose, against the roller.

15 Claims, 3 Drawing Figures

Fig.1
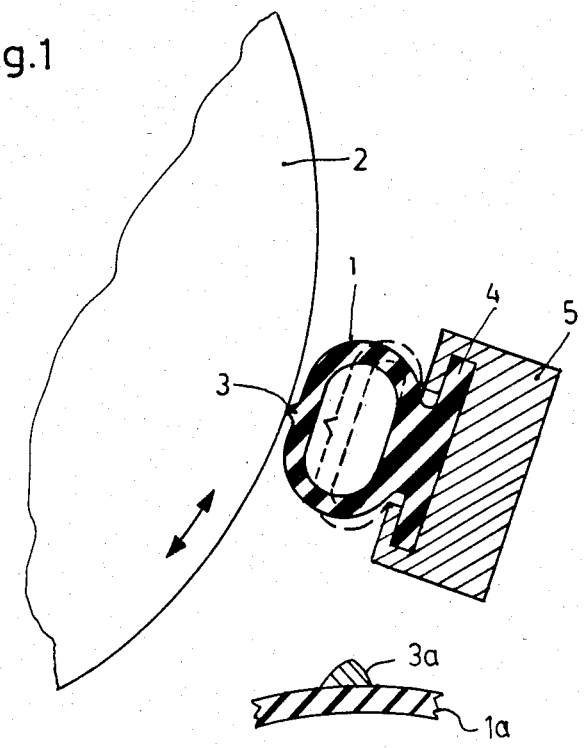
Fig. 1a
Fig.2
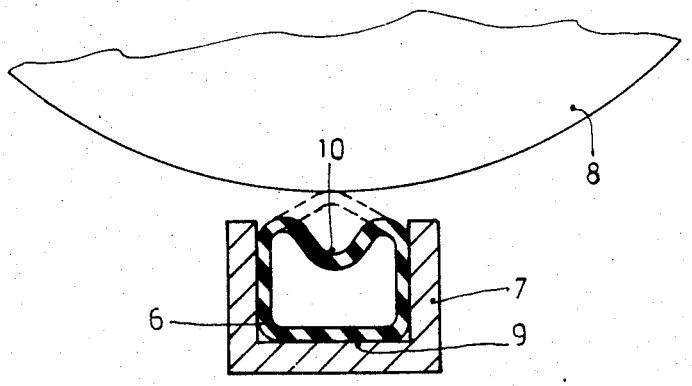

STRIPPER FOR A ROLLER CLEANING DEVICE

The invention relates to a stripper for a device for cleaning the rollers of a printing machine.

BACKGROUND

A stripper of this kind is known from U.S. Pat. No. 2,199,469. It comprises a stripper blade, which is screwed onto a pivotable carrier and by the pivoting of the carrier can be positioned against a roller of the printing machine roller train to be cleaned. With such an arrangement there is the danger that the stripper blade cannot be positioned over the full width with uniform pressure against the roller to be stripped, both because of tensions arising as it is screwed on and because of twisting of the blade carrier. The disadvantage then is, first, that the roller is not completely stripped clean, and second, that there is a danger that the parts of the stripper that are positioned under high pressure may be partly ground away by the roller. In addition to these considerations, a stripper device of this kind is made up of a plurality of parts. In the case of machines with reversible rotation and where because of restricted space the stripper is arranged for counter-rotation stripping actions, there is a further danger that in the event of non-uniform positioning the roller will carry the edge of the stripper along with it, thereby snapping the stripper over into a sliding position.

THE INVENTION

It is accordingly a principal object of the invention to create a stripper of the generic type discussed above which is very simple in design, and which rests with a uniform pressing force against the roller that is to be cleaned over the entire width of this roller.

Briefly, a hose which can be pressurized, and thus change its volume, is retained on a support rail, parallel to the roller to be stripped. Upon pressurization, for instance with compressed air, the hose expands and, due to the positioning of the rail, contacts the surface of the roll to be cleaned. Preferably, the hose normally has an oval cross section, and is formed with a stripping bead or rib, the wider region of the oval being secured to the rail at the side remote from the roller, and the rib or bead being formed close to the roller. Upon pressurization, the rib or bead is pressed against the roller, for stripping off any surface accumulations, for example of ink, therefore. In accordance with a feature of the invention, the hose may be pre-shaped or pre-formed to have normally a concave portion in the zone facing the roller; upon pressurization, the concave zone snaps outwardly, to form a projecting region contacting the roller, for stripping surface accumulations therefrom. The bead or ridge or rib can be formed on this type of hose as well; the bead or ridge may be integral with the hose material, or formed of different material, for example somewhat harder than the material of the hose, typically rubber, and secured to the hose by an adhesive.

Further features and advantages of the invention will become apparent from the ensuing detailed description of the exemplary embodiments, taken in conjunction with the drawing.

DRAWING

FIG. 1 is a sectional view of a first exemplary embodiment of a stripper according to the invention;

FIG. 1*a* is a fragmentary sectional view of another embodiment; and

FIG. 2 is a sectional view of a further exemplary embodiment.

DETAILED DESCRIPTION

The stripper according to FIG. 1 includes a shaped pressure hose 1, which can be pressurized or pressure-relieved using compressed air. The shaped pressure hose 1, of oval cross section, is provided on the side oriented toward a roller 2 to be stripped with a stripping rib or bead 3. This rib or bead may, as shown in the exemplary embodiment, be produced integrally with the shaped hose 1. The possibility also exists, hwoever (see FIG. 1*a*) of fabricating the stripping rib or bead 3*a* from some harder material and then firmly joining it to the shaped pressure hose 1*a*, for instance by using an adhesive. It is also possible for two or more stripping ribs or beads to be provided.

The side of the shaped pressure hose remote from the roller 2 is provided with a bottom strip 4. This bottom strip 4, in order to fix the position of the shaped hose 1, engages an approximately T-shaped guide of a rigid support rail 5, which is secured in a manner not shown in detail to the side walls on which the shaft of the roller 2 is also supported.

OPERATION

The shaped pressure hose 1 is embodied such that in the pressure-relieved position it assumes the position shown in dashed lines. Upon pressurization, the shaped pressure hose 1 arches into the position shown in solid lines, so that the stripping rib 3 comes into contact with the roller 2. Since the pressing force with which the stripping rib is pressed against the buffer 2 is constant over the entire length of the roller 2, the stripping rib 3 rests uniformly against this roller, and the roller is thus stripped clean in an entirely uniform manner. Since no pivoting movements are necessary for positioning the stripping rib in and out of engagement, the elimination of pivot bearings results in a very simple, space-saving structure.

In the exemplary embodiment according to FIG. 2, a pre-formed shaped pressure hose 6 is used, which is inserted into a rigid support rail 7 of U-shaped cross section. The surface 9 of the shaped hose remote from the roller 8 that is to be stripped is joined firmly to the rail 7 by means of an adhesive. The interior of the shaped hose 6 is again pressurizable or pressure-relievable using compressed air. In the pre-formed, or pre-set, pressure-relieved position shown in solid lines, the surface 10 of the shaped hose 6 oriented toward the roller 8 to be stripped has a concave curvature, so that no contact takes place in this position between the surface 10 and the roller 8. Upon pressurization of the interior of the shaped hose 6, the surface is arched outward, as indicated by dashed lines, and thereby comes to rest against the roller 8. Here again, the shaped pressure hose 6 rests with a uniform pressing force against the roller 8 over the entire length thereof.

I claim:

1. In combination with a printing machine having a roller (2, 8), the surface of which is to be cleaned or stripped, a stripping device for cleaning said roller (2, 8) comprising, in accordance with the invention, a support rail (5, 7) extending axially parallel to the roller (2, 8) to be cleaned;

and a pressure hose (1, 6) secured to the rail with a surface thereof remote from the roller (2, 8) and extending axially along the roller, the pressure hose being expandable in cross section upon pressurization with a pressure fluid, and thereby engageable with the facing surface of the roller at a pressure which is essentially uniform over the axial length of the roller.

2. Stripping device according to claim 1, wherein the surface remote from the rail (5) carries at least one stripping rib or bead (3) extending parallel to the axis of the roller (2).

3. Stripping device according to claim 2, wherein the stripping rib (3) is fabricated integrally with the pressure hose (1).

4. The stripping device according to claim 2, wherein the stripping rib 83) and the pressure hose (1) and fabricated of different materials and are joined firmly to one another, for example by means of an adhesive.

5. Stripping device according to claim 1, wherein (FIG. 2) the pressure hose is a pre-set, or pre-formed profile hose having, in cross section, an inwardly extending or concave bulge, when in pressurized condition, said bulge, upon pressurization, snapping outwardly and engaging the facing surface of the roller.

6. Stripping device according to claim 5, wherein the surface remote from the rail (5) carries at least one stripping rib or bead (3) extending parallel to the axis of the roller (2).

7. Stripping device according to claim 6, wherein the stripping rib (3) is fabricated integrally with the pressure hose (1).

8. Stripping device according to claim 6, wherein the stripping rib (3) and the pressure hose (1) are fabricated of different materials and are joined firmly to one another, for example by means of an adhesive.

9. Stripping device according to claim 1, wherein (FIG. 1) the pressure hose, in cross section, is approximately oval, engaging said rail (5) with one major flat surface, and having another major flat surface facing the roller (2).

10. Stripping device according to claim 6, wherein the surface remote from the rail (5) carries at least one stripping rib or bead (3) extending parallel to the axis of the roller (2).

11. Stripping device according to claim 10, wherein the stripping rib (3) is fabricated integrally with the pressure hose (1).

12. Stripping device according to claim 10, wherein the stripping rib (3) and the pressure hose (1) are fabricated of different materials and are joined firmly to one another, for example by means of an adhesive.

13. In combination with a printing machine having a roller 82, 8), the surface of which tends to accumulate ink, which ink is to be cleaned or stripped off said surface, an ink cleaning or stripping device for cleaning the surface of said roller (2, 8) and stripping ink accumulated on said surface from said roller, comprising, in accordance with the invention, a support rail (5, 7) extending axially parallel to the roller (2, 8) to be cleaned;

a pressure hose (1, 6) secured to the rail with a surface thereof remote from the roller (2, 8) and extending axially along the roller, the pressure hose being expandable in cross section upon pressurization with a pressure fluid, and thereby engageable with the facing surface of the roller at a pressure which is essentially uniform over the axial length of the roller.

14. Stripping device according to claim 13, wherein the surface remote from the rail (5) carries at least one stripping rib or bead (3)extending parallel to the axis of the roller (2).

15. Stripping device according to claim 13, wherein (FIG. 2) the pressure hose is a pre-set, or pre-formed profile hose having, in cross section, an inwardly extending or concave bulge, when in unpressurized condition, said bulge, upon pressurization, snapping outwardly and engaging the facing surface of the roller.

* * * * *

UNITED STATES PATENT AND TRADEMARK OFFICE

CERTIFICATE OF CORRECTION

PATENT NO. : 4,537,130

DATED : August 27, 1985

INVENTOR(S) : Klaus THEILACKER

It is certified that error appears in the above-identified patent and that said Letters Patent is hereby corrected as shown below:

Column 1 , line 42, "roll" should be -- roller --

Column 3, Claim 4, line 18, "hose (1) and" should be -- hose (1) are --

Column 4, Claim 10, "claim 6" should read -- claim 9 --

Column 4, Claim 13, line 15, "roller 82, 8" should read -- roller (2, 8) --

Signed and Sealed this

*Twenty-fifth* Day of *February 1986*

[SEAL]

*Attest:*

DONALD J. QUIGG

*Attesting Officer*

*Commissioner of Patents and Trademarks*